US012410996B2

(12) United States Patent
Niklas et al.

(10) Patent No.: US 12,410,996 B2
(45) Date of Patent: Sep. 9, 2025

(54) PROJECTILE, AMMUNITION AND METHOD OF MANUFACTURING A PROJECTILE

(71) Applicant: RWS GmbH, Fürth (DE)

(72) Inventors: Nicole Niklas, Nuremberg (DE); Thomas Wagner, Pinzberg (DE)

(73) Assignee: RWS GMBH, Fürth (DE)

( * ) Notice: Subject to any disclaimer, the term of this patent is extended or adjusted under 35 U.S.C. 154(b) by 0 days.

(21) Appl. No.: 18/575,620

(22) PCT Filed: Jul. 1, 2022

(86) PCT No.: PCT/EP2022/068336
§ 371 (c)(1),
(2) Date: Dec. 29, 2023

(87) PCT Pub. No.: WO2023/275388
PCT Pub. Date: Jan. 5, 2023

(65) Prior Publication Data

US 2024/0310153 A1 Sep. 19, 2024

(30) Foreign Application Priority Data

Jul. 2, 2021 (DE) ..... 10 2021 117 140.7

(51) Int. Cl.
*F42B 12/74* (2006.01)

(52) U.S. Cl.
CPC ..... *F42B 12/745* (2013.01)

(58) Field of Classification Search
CPC ..... F42B 12/745
USPC ..... 102/501
See application file for complete search history.

(56) References Cited

U.S. PATENT DOCUMENTS

| | | | | |
|---|---|---|---|---|
| 3,580,965 | A | 5/1971 | Brinkmann et al. | |
| 4,005,660 | A | 2/1977 | Pichard | |
| 5,949,016 | A * | 9/1999 | Baroody | C06B 33/08 149/19.5 |
| 6,101,949 | A * | 8/2000 | Maucourt | C22C 32/0094 102/501 |
| 6,158,351 | A | 12/2000 | Mracic et al. | |
| 6,295,933 | B1 * | 10/2001 | Dubocage | F42B 12/745 102/501 |
| 6,576,697 | B1 | 6/2003 | Brown, Jr. | |
| 2008/0236435 | A1 | 10/2008 | Danon et al. | |
| 2010/0064927 | A1 | 3/2010 | Perrone | |
| 2012/0308426 | A1 | 12/2012 | Perez et al. | |
| 2013/0055917 | A1 * | 3/2013 | Menefee, III | F42B 7/10 102/370 |
| 2016/0153757 | A1 * | 6/2016 | Mahnke | F42B 12/02 102/501 |
| 2019/0265010 | A1 | 8/2019 | Greene et al. | |

FOREIGN PATENT DOCUMENTS

| | | | | |
|---|---|---|---|---|
| DE | 19924747 | A | 12/2000 | |
| DE | 69718452 | T2 | 11/2003 | |
| DE | 69736978 | T2 | 6/2007 | |
| DE | 102020105266 | A1 | 9/2021 | |
| EP | 0890076 | A1 | 1/1999 | |
| EP | 0907680 | A1 | 4/1999 | |
| EP | 3872439 | A1 * | 9/2021 | F42B 33/00 |
| WO | WO-2008097392 | A2 * | 8/2008 | F42B 14/064 |
| WO | WO-2021173709 | A1 * | 9/2021 | B32B 13/02 |

OTHER PUBLICATIONS

"Projectile, Ammunition and Method for Manufacturing a Projectile" (Year: 2021).*
DD (Year: 00).*
Office Action dated Oct. 20, 2023 in DE Appln. No. 10 2021 117 140.7.
Office Action dated Jan. 26, 2022 in DE Appln. No. 10 2021 117 140.7.
International Search Report dated Oct. 12, 2022 in PCT/EP2022/068336.

* cited by examiner

*Primary Examiner* — Samir Abdosh
(74) *Attorney, Agent, or Firm* — FITCH, EVEN, TABIN & FLANNERY, LLP

(57) ABSTRACT

Projectile, in particular a propellant charge projectile or compressed air projectile, wherein the projectile is made from a mixture comprising metal and 2 to 15% by weight of plastic, preferably thermoplastic elastomer, based on the total weight of the propellant charge projectile; ammunition comprising the projectile and method for its manufacture.

16 Claims, No Drawings

PROJECTILE, AMMUNITION AND METHOD OF MANUFACTURING A PROJECTILE

CROSS-REFERENCE TO RELATED APPLICATIONS

This application is a U.S. national phase application filed under 35 U.S.C. § 371 of International Application No. PCT/EP2022/068336, filed Jul. 1, 2022, designating the United States, which claims priority from German Application No. 10 2021 117 140.7, filed Jul. 2, 2021, which are incorporated herein by reference in their entireties.

The invention relates to a projectile, in particular a propellant charge projectile. Furthermore, the present invention provides ammunition. Furthermore, the present invention relates to a method of manufacturing a projectile, in particular a propellant charge projectile.

Projectiles are often made of lead. However, due to the increasing demand for environmentally friendly projectile materials, the use of lead is becoming more and more unsuitable. Alternative materials, such as tin or zinc, have rarely been used to date, as these materials are significantly more expensive than lead and also have a lower density compared to lead, which means that the projectiles have reduced precision at longer distances.

Furthermore, it is already known in the state of the art to use plastic for the production of rifle bullets. However, due to the low density of plastic, plastic rifle bullets have poor precision. Furthermore, additional friction losses occur between the bullet and the barrel of the firearm, which in turn guides to a reduction in muzzle energy.

DE 199 24 747 A1 discloses a lead-free bullet for handguns with a core of biodegradable moulding compound and a metallic and/or mineral filler as well as a metallic or non-metallic coating.

U.S. Pat. No. 6,158,351 A discloses a lead-free ferromagnetic object. The object is a compacted composite material comprising a heavier denser component, preferably consisting of iron, and a less dense second component which is either a metal alloy or a polymer. The ferromagnetic component is present in an amount sufficient to impart ferromagnetism to the object. The ferromagnetic property allows fragments of the object, such as a projectile, a sphere or a shaped charge carrier, to be separated from dirt or other surroundings.

One task of the present invention is to overcome the disadvantages of the prior art, in particular to provide a projectile, for example a propellant charge projectile, which has improved precision and/or ballistics.

The task is solved by the object of claims 1, 13, 14 and 15, respectively.

The problem is solved in particular by a propellant charge projectile, i.e. a bullet or projectile which is accelerated by means of propellant charge conversion within a firearm, wherein the propellant charge projectile is made of a mixture comprising metal and 2 to 15% by weight of plastic, based on the total weight of the propellant charge projectile.

In contrast to a projectile that is accelerated by air pressure, a propellant charge projectile has a specific high-strength structure. It is arranged to be detachably attached to a case containing a propellant charge to form an ammunition or cartridge for a specific application.

This propellant charge ammunition with a propellant charge projectile also comprises a primer that is attached to the case in order to be activated electrically or mechanically. The activated primer sets the propellant charge, which accelerates the propellant charge projectile.

Preferably, the propellant charge projectile according to the invention has a calibre of less than 25 mm, in particular 20 mm, in particular 15 mm, in particular 13 mm.

The propellant charge projectile according to the invention can be formed from a single material, in particular turned, cold-formed or injection-moulded. It can also consist of several components, wherein at least one part, preferably a predominant part, is made of the mixture of metal and plastic according to the invention, in particular injection-moulded. It can be a full and partial jacket bullet. The same applies to the projectile described below in general.

The projectile tip or ogive can be pointed or convex in shape. The so-called, in particular cylindrical, projectile shoe is preferably connected to the projectile tip in the opposite direction to the direction of flight and terminates in a tail end that is in particular cut off or cut to length or straight. The surface of the propellant charge projectile can be provided with notches in order to optimise ballistics. The same applies to the projectile described below in general.

The mixture of plastic and metal according to the invention has shown particularly good guiding properties within the barrel of the firearm, wherein it has guided surprisingly little wear. Of course, the bullet can be provided with grooves or grease grooves to improve bullet lubrication.

The propellant charge projectile is made of a mixture comprising metal and 2 to 15% by weight of plastic, based on the total weight of the propellant charge projectile. According to an exemplary further development, the propellant charge projectile is lead-free, i.e. manufactured without the addition of lead. It may be provided that the plastic used is capable of absorbing the metal content, in particular evenly. Furthermore, the plastic can be selected in such a way that good processing is possible and the plastic is not too brittle. According to the present invention, it has been found that an optimum of density, in particular high density, and ductility is achieved by means of the specific weight proportion of 2 to 15% by weight of plastic, whereby improved precision can be achieved.

The propellant charge projectile according to the invention has numerous internal and end-ballistic advantages.

Bullets must have a calibre-dependent defined pull-out resistance from the case. The bullet must not spin and be too loose. At the same time, a uniform retention force at the exit of the bullet has a positive effect on uniform gas pressure. This is crucial for good accuracy. Soft materials such as lead or tin are advantageous here, as they yield when the case is pinched or applied and the extraction resistance can be set in a defined manner. However, these metals have the disadvantages mentioned above. With harder materials, a groove is often added to the bullet in which the bullet is pinched. With brittle bullets, on the other hand, the application of the case mouth can lead to significant variances, as the material can tear brittlely if too high pinch forces are used or the bullet is too loose. Elastic metal-plastic bullets as described here, on the other hand, give way when the case mouth is applied.

When the bullet leaves the case, there is a short free-flight phase until the bullet enters the barrel. The compliance of the bullet material determines the press-fit resistance when the bullet enters the land-and-groove profile of the rifled barrel section. If the bullet resistance is too high, as is often the case with hard materials, a high gas pressure can be briefly shifted towards the chamber, which not only has a negative effect on the muzzle velocity, but also on the barrel oscillation behaviour, and ultimately on the point of impact and overall accuracy.

Furthermore, with harder materials, one-sided bullet wear can occur when the bullet enters the barrel if the bullet does not enter the barrel with ideal centrosymmetry in free flight (between leaving the case and entering the barrel). The one-sided abrasion results in an eccentric axis of rotation during twist transmission, causing the bullet to tumble as it exits the muzzle. Compared to brittle materials, these effects are reduced in the mixtures of metal and plastic according to the invention, especially if the preferred thermoplastic elastomers are used as the plastic. In such a case, a behaviour analogous to a soft material, such as lead, can be observed, accompanied by a significant improvement in precision.

In addition, such a projectile can press itself better into the land-and-groove profile as it passes through it, resulting in optimum spin transfer and reduced gas slip.

All these effects are particularly pronounced for the thermoplastic elastomers described herein.

According to an exemplary further development, it is provided that the metal is only a single metal or is a mixture of two or more different metals. It may also be provided that the plastic is only a single plastic or is a mixture of two or more plastics. Furthermore, it may be provided that the mixture consists of the metal and plastic.

In a further exemplary further development of the projectile according to the invention, additives can be added or mixed into the mixture from which the projectile is made. For example, inorganic substances or materials, such as granite, sand, quartz glass clay, cement, or ceramic sintered materials or the like, can be considered. Processing additives, for example antioxidants or stabilisers or, in particular, lubricants such as waxes or dry lubricants such as stearates (calcium stearate, zinc stearate), MoS2, graphite (dry lubricant) can also be added to the mixture. The addition of a lubricant can increase the flowability of the mixture in the melt during the production of the projectile. In the finished product, a lubricant in the mixture can improve the running smoothness by reducing friction. It has been found, particularly with regard to the weight and thus the precision of the projectile, that the additives should be present in a maximum proportion, in particular in such a way that the additives replace the metal in a maximum proportion of 10% by weight.

In an exemplary embodiment, the metal (or the mixture of two or more metals) is present in the propellant charge projectile in an amount of 85 to 98% by weight, in particular in an amount of 93 to 97% by weight, 94 to 96% by weight of about 95% by weight, based on the total weight of the propellant charge projectile. The presence of a high percentage by weight of metal according to the invention increases the density of the propellant charge projectile, which has a positive effect on precision.

It may be provided that the metal is selected from the group consisting of copper, iron, zinc, tin, magnesium, tungsten, lead, hard metal, sintered metal and mixtures thereof.

It may be provided that the metal is selected from the group consisting of copper, iron, zinc, tin, magnesium, tungsten, hard metal, sintered metal and mixtures thereof, preferably copper.

In an exemplary embodiment of the present invention, the metal is present in the propellant charge projectile in the form of particles. For example, particles with one of the following morphologies or mixtures of particles with two or more of the following morphologies may be provided: spacy, lamellar, dendritic or spherical ("ball-shaped"). By selecting the morphology, the processing properties of the mixture can be adjusted and, as a result, the projectile properties can be improved.

In particular, for example, it can be provided that the particles are spherical particles. In this context, a particle is to be regarded as spherical if the ratio of the smallest diameter of the particle to the largest diameter of the particle is from 0.8 to 1, preferably from 0.9 to 1, more preferably from 0.95 to 1. The particles of the metal are to be regarded as spherical overall if at least 90%, preferably 95%, more preferably at least 97%, most preferably at least 99% of the particles are spherical within the meaning of the preceding definition.

In an exemplary embodiment of the present invention, the metal in the propellant charge projectile is present in the form of particles, wherein the particles have a median diameter D50 of 5 to 100 μm, preferably 6 to 90 μm, more preferably 8 to 85 μm and/or a D10 of 2 to 65 μm, preferably 3 to 70 μm, more preferably 3.5 to 60 μm and/or a D90 of 10 to 150 μm, preferably 12 to 140 μm, more preferably 15 to 135 μm.

In an exemplary embodiment of the present invention, the metal in the propellant charge projectile is in the form of particles, wherein the particles have a median diameter D50 of 5 to 50 μm, preferably 6 to 40 μm, more preferably 8 to 35 μm and/or a D10 of 2 to 25 μm, preferably 3 to 20 μm, more preferably 3.5 to 15 μm and/or a D90 of 20 to 120 μm, preferably 25 to 100 μm, more preferably 28 to 90 μm.

In an exemplary embodiment of the present invention, the metal in the propellant charge projectile is in the form of particles, wherein the particles have a median diameter D50 of 5 to 12 μm, preferably 6 to 10 μm, more preferably 8 to 9 μm and/or a D10 of 2 to 5 μm, preferably 3 to 4.5 μm, more preferably 3.5 to 4 μm and/or a D90 of 20 to 50 μm, preferably 25 to 40 μm, more preferably 26 to 30 μm.

In an exemplary embodiment of the present invention, the metal in the propellant charge projectile is in the form of particles, wherein the particles have a median diameter D50 of 10 to 20 μm, preferably 11 to 19 μm, more preferably 12 to 18 μm and/or a D10 of 5 to 8 μm, preferably 5.5 to 6.5 μm, more preferably 6 to 7 μm and/or a D90 of 25 to 75 μm, preferably 30 to 70 μm, more preferably 32 to 65 μm.

In an exemplary embodiment of the present invention, the metal in the propellant charge projectile is present in the form of particles, wherein the particles have a median diameter D50 of 25 to 40 μm, preferably 28 to 38 μm, more preferably 30 to 35 μm and/or a D10 of 7 to 15 μm, preferably 9 to 13 μm, more preferably 10 to 12 μm and/or a D90 of 70 to 95 μm, preferably 75 to 90 μm, more preferably 80 to 85 μm.

In an exemplary embodiment of the present invention, the metal in the propellant charge projectile is in the form of particles, wherein the particles have a median diameter D50 of 15 to 30 μm, preferably 18 to 28 μm, more preferably 20 to 25 μm and/or a D10 of 6 to 12 μm, preferably 7 to 11 μm, more preferably 10 to 12 μm and/or a D90 of 45 to 75 μm, preferably 50 to 70 μm, more preferably 55 to 65 μm.

In an exemplary embodiment of the present invention, the metal in the propellant charge projectile is present in the form of particles, wherein the particles have a median diameter D50 of 25 to 50 μm, preferably 28 to 36 μm, more preferably 30 to 34 μm and/or a D10 of 10 to 22 μm, preferably 13 to 19 μm, more preferably 15 to 17 μm and/or a D90 of 40 to 70 μm, preferably 45 to 65 μm, more preferably 50 to 55 μm.

D50 means that 50% of the particles contained in the analysed sample are smaller (=have a smaller diameter) than the specified value. D90 means that 90% of the particles contained in the analysed sample are smaller (=have a smaller diameter) than the specified value. D10 means that 10% of the particles contained in the analysed sample are smaller (=have a smaller diameter) than the specified value.

A monomodal particle size distribution with one of the preceding D10, D50 and D90 may be advantageous to obtain a reproducible characteristic property profile.

In an exemplary embodiment of the present invention, the metal in the propellant charge projectile is in the form of particles, wherein a width of the size distribution of the particles is from 0.5 to 10, preferably from 1 to 5.

In an exemplary embodiment of the present invention, the metal in the propellant charge projectile is in the form of particles, wherein a width of the size distribution of the particles is from 1.5 to 4.5, preferably from 1.7 to 4.1.

In an exemplary embodiment of the present invention, the metal in the propellant charge projectile is in the form of particles, wherein a width of the size distribution of the particles is from 2 to 3, preferably from 2.5 to 2.7.

In an exemplary embodiment of the present invention, the metal in the propellant charge projectile is in the form of particles, wherein a width of the size distribution of the particles is from 2 to 3, preferably from 2.5 to 2.7.

In an exemplary embodiment of the present invention, the metal in the propellant charge projectile is in the form of particles, wherein a width of the size distribution of the particles is from 2 to 2.6, preferably from 2.2 to 2.4.

A narrow size distribution can be advantageous in order to achieve a reproducible characteristic property profile. However, in order to obtain a good degree of filling at the same time, a certain width of the size distribution of the particles is advantageous. The preceding preferred portions of the size distribution of the particles are advantageous in order to take both aspects into account.

The width of the size distribution is defined as (D90-D10)/D50. The width of the size distribution shows how far apart the 10 percent and 90 percent points (D10 and D90) are, normalised by the centre point (D50). The size of the particles in this context refers to the diameter of the particles. In the event that the particles are not spherical, the diameter refers to the smallest diameter of the particles, i.e. the smallest distance between two opposing outer surfaces of the particle.

It may be provided that the metal in the propellant charge projectile is present in the form of particles and that the distribution of the diameters of the particles is a multimodal distribution, such as a bimodal distribution or a trimodal distribution. It may be provided that a mixture of two or more types of particles with D10, D50 and D90 values and/or widths of the size distribution mentioned as examples in the foregoing is used. This allows particularly high filling levels, i.e. large amounts of metal in the projectile and thus a high density, to be obtained and precision to be increased. There are also advantages with regard to the properties of the projectile produced in terms of agglomeration, segregation, shrinkage cavities, etc., which also contributes to an increase in precision.

A bimodal distribution is a frequency distribution that has two local maxima. A trimodal distribution is a frequency distribution that has three local maxima. A bimodal distribution of the diameters of the particles may be present, for example, if a mixture of a first type of particle and a second type of particle is used as the particle, wherein the first type of particle has a smaller mean diameter (or a smaller D50) than the second type of particle.

It may be provided that the metal in the propellant charge projectile is in the form of particles and a mixture of a first type of particles and a second type of particles is used as the particles, wherein the first type of particles has a wide particle size distribution (D10 <<D50 <<D90) and the second type of particles has a narrow particle size distribution, wherein the particle size may be indicated by the diameter of the particles. This may also result in a higher density of the particles (and thereby of the metal) in the propellant charge projectile, thereby increasing precision.

According to a further exemplary embodiment of the propellant charge projectile according to the invention, the particles have an average diameter of 5 to 27 μm. It may also be provided that the particle diameters are in a portion of 1 to 60 μm, preferably 3 to 45 μm. It may be provided that at least 90% of the particles, particularly preferably at least 95% of the particles, more preferably at least 97%, most preferably at least 99% of the particles have a corresponding diameter.

The diameter of the particles is determined according to the invention as follows. Metallographic half-sections are made of a sample ((propellant charge) projectile) produced by injection moulding (cold embedding of the samples using Technovit® 4071, grinding with paper of different grain sizes, polishing with diamond suspension). A light microscope is used to take receptacles at 200× and 500× magnification at exemplary positions on the test specimen (inside and outside). The diameters of the Cu particles are then determined using microscope software. The diameter of 500 particles is determined for the evaluation.

According to an exemplary further development of the present invention, the plastic is a thermoplastic elastomer. By using a thermoplastic elastomer instead of other, in particular more brittle plastics, improved precision can be achieved.

Likewise, the elastic properties of the thermoplastic elastomer mean that the larger particles produced on impact of the projectile do not lead to a background hazard.

Thermoplastic elastomers are capable of absorbing larger proportions of metal, in particular metal particles such as metal powder. Surprisingly, it has been found in the context of the invention that such a mixture of thermoplastic elastomer and metal is particularly suitable for producing the propellant charge projectile according to the invention, in particular to improve its precision. For the purposes of the present disclosure, an elastomer is a dimensionally stable but elastically deformable plastic. The elastomer can be elastically deformed by tensile and compressive loading. For the purposes of the present disclosure, a thermoplastic elastomer is a plastic that behaves similarly to another (non-thermoplastic) elastomer at room temperature, but can be plastically deformed when heat is applied. The thermoplastic elastomer (or the mixture of two or more different thermoplastic elastomers) is contained in the mixture from which the propellant charge projectile is formed in an amount of 2 to 15% by weight, in particular in an amount of 3 to 7% by weight, 3 to 6% by weight or about 4 to 6% by weight, based on the total weight of the propellant charge projectile. According to an exemplary further development, the plastic can be selected from homopolymers or copolymers which, in polymerised form, contain at least one monomer selected from C2-C10 monoolefins, such as ethylene or propylene, 1,3-butadiene, 2-chloro-1,3-butadiene, vinyl alcohol and its C2-C1o-alkyl esters, vinyl chloride, vinylidene chloride, vinylidene fluoride, tetrafluoroethylene, glycidyl acrylate, glycidyl methacrylate, acrylates and methacrylates with alcohol components of branched and unbranched C1-C1o alcohols, vinylaromatics such as styrene, (meth)acrylonitrile, α,β-ethylenically unsaturated mono-and dicarboxylic acids, and maleic anhydride;

Homo- and copolymers of vinyl acetals;

Polyvinyl esters;

polycarbonates (PC);

Polyesters, such as polyalkylene terephthalates, polyhydroxyalkanoates (PHA), polybutylene succinates (PBS), polybutylene succinate adipates (PBSA);

polyethers;

polyether ketones;

thermoplastic polyurethanes (TPU);

polysulphides;

polysulfones;

natural rubber and mixtures thereof.

Examples include olefin copolymers, such as ethylene copolymers, olefin-alkyl acrylate copolymers, such as ethylene-alkyl acrylate copolymers, olefin-vinyl ester copolymers, such as ethylene-vinyl acetate copolymers, polyacrylates with the same or different alcohol residues from the group of C4-C8 alcohols, especially butanol, hexanol, octanol and 2-ethylhexanol, polymethyl methacrylate (PMMA), methyl methacrylate-butyl acrylate copolymers, acrylonitrile-butadiene-styrene copolymers (ABS), ethylene-propylene copolymers, ethylene-propylene-diene copolymers (EPDM), Polystyrene (PS), styrene-acrylonitrile copolymers (SAN), acrylonitrile-styrene-acrylate (ASA), styrene-butadiene-methyl methacrylate copolymers (SBMMA), styrene-maleic anhydride copolymers, styrene-methacrylic acid copolymers (SMA), polyoxymethylene (POM), polyvinyl alcohol (PVAL), polyvinyl acetate (PVA), polyvinyl butyral (PVB), polycaprolactone (PCL), polyhydroxybutyric acid (PHB), polyhydroxyvaleric acid (PHV), polylactic acid (PLA), ethyl cellulose (EC), cellulose acetate (CA), cellulose propionate (CP) or cellulose acetate/butyrate (CAB).

Thermoplastic elastomers have both thermoplastic and elastomeric properties. Thermoplastic elastomers may in particular be selected from olefin-alkyl acrylate copolymer, for example ethylene-alkyl acrylate copolymer, olefin-vinyl ester copolymer, for example ethylene-vinyl acetate copolymer, thermoplastic elastomeric polyurethanes, thermoplastic elastomeric vulcanisates, thermoplastic elastomeric olefins, thermoplastic elastomeric polyamides, thermoplastic elastomeric styrenics, thermoplastic elastomeric copolyesters and combinations thereof.

According to an exemplary further development, the thermoplastic elastomer is an olefin copolymer in which an olefin monomer, preferably an α-olefin comonomer, wherein this term expressly includes ethylene in the sense of the present disclosure, is copolymerised with a further monomer. Examples of such further monomers which may be copolymerised with the olefin monomer are, for example, acrylic acid, acrylic acid derivative, methacrylic acid, methacrylic acid derivative, aromatic vinyl derivative, vinyl cyanide derivative or vinyl ester. Examples of the acrylic acid derivative are methyl acrylate, n-butyl acrylate, ethyl acrylate, n-propyl acrylate, n-butyl acrylate, isobutyl acrylate, t-butyl acrylate, cyclohexyl acrylate, 2-hydroxyethyl acrylate and acrylate. Examples include acrylic acid esters such as 2-phenoxyethyl, benzyl acrylate, 2-(N,N-dimethylamino)ethyl acrylate and glycidyl acrylate. Examples of the methacrylic acid derivative are ethyl methacrylate, n-propyl methacrylate, n-butyl methacrylate, isobutyl methacrylate, t-butyl methacrylate, phenyl methacrylate, benzyl methacrylate, cyclohexyl methacrylate and 2-phenoxymethacrylate. Examples include methacrylic acid esters such as ethyl methacrylate, isobornyl methacrylate, dicyclopentenyl methacrylate, glycidyl methacrylate and adamantyl methacrylate. Examples of the aromatic vinyl derivative are styrene, vinyltoluene, α-methylstyrene and the like. Examples of the halogenated vinylidene are vinylidene chloride and vinylidene fluoride. Examples of the vinyl ester are vinyl acetate.

According to an exemplary further development, the plastic is selected from an α-olefin-vinyl ester copolymer, an α-olefin-alkyl acrylate copolymer or mixtures of two or more thereof. Preferably, the plastic is selected from an ethylene-vinyl ester copolymer, an ethylene-alkyl acrylate copolymer or mixtures of two or more thereof. This makes it possible to obtain particularly favourable mechanical properties (in particular modulus of elasticity, tensile strength, flexural modulus, flexural strength, etc.) of the mixture with the metal contained in the projectile.

The use of α-olefin-vinyl ester copolymer and/or α-olefin-alkyl acrylate copolymer as a plastic in the mixture is particularly advantageous in order to achieve a behaviour analogous to a conventional soft material, such as lead. This allows a significant improvement in precision to be achieved. Particularly good results in terms of precision have been observed for the embodiments described below. In addition, optimisation of the swirl transmission can be achieved and the gas slip reduced. Particularly advantageous in this context are ethylene-vinyl ester copolymer, an ethylene-alkyl acrylate copolymer or mixtures of two or more thereof, most preferably ethylene-methyl acrylate copolymer, ethylene-butyl acrylate copolymer, ethylene-vinyl actetate copolymer and mixtures of two or more thereof.

In addition, the use of α-olefin-vinyl ester copolymer and/or α-olefin-alkyl acrylate copolymer as a plastic in the mixture of the propellant charge projectile can significantly reduce heavy dust generation when the projectile strikes a target. This is particularly advantageous when the projectile is used in enclosed spaces (such as a shooting range). Particularly advantageous in this context are ethylene-vinyl ester copolymer, an ethylene-alkyl acrylate copolymer or mixtures of two or more thereof, most preferably ethylene-methyl acrylate copolymer, ethylene-butyl acrylate copolymer, ethylene-vinyl actetate copolymer and mixtures of two or more thereof.

According to an exemplary further development, the thermoplastic elastomer is an α-olefin-vinyl ester copolymer. In this context, it may be provided that the vinyl ester is a vinyl acyl ester, preferably vinyl acetate, vinyl propionate, vinyl butyrate, vinyl valerate, vinyl hexanoate, vinyl heptanoate, vinyl octanoate, vinyl nonanoate, or vinyl deacnoate. In this context, it may further be provided that α-olefin is one or more of ethylene (which is to be understood as α-olefin in this context) propylene, 1-butene, 1-pentene, 1-hexene, 1-heptene, 1-octene, 1-decene, 1-undecene, 1-icosen, and 1-docosen. The use of olefin-vinyl ester copolymers as plastics is advantageous due to the moisture resistance of these materials. Many plastics, such as polyamides, are known to absorb water in the form of atmospheric moisture. Such plastics must therefore be dried before injection moulding. The remaining water content has a significant influence on the mechanical properties of the resulting product. The use of olefin-vinyl ester copolymers that are resistant to moisture therefore reduces unwanted variance in the mechanical properties of the propellant charge projectile due to environmental influences during production. Similarly, α-olefin-vinyl ester copolymers are advantageous due to their stability to UV radiation.

According to an exemplary further development, the proportion of vinyl ester in the α-olefin-vinyl ester copolymer is at least 1% by weight, preferably at least 2% by weight, preferably at least 3% by weight, preferably at least 4% by weight, preferably at least 5% by weight, preferably at least 6% by weight, preferably at least 7% by weight, preferably at least 8% by weight, preferably at least 9% by weight, in each case based on the total weight of the α-olefin vinyl ester copolymer. Particularly good mechanical properties and particularly good precision of the propellant charge projectile can be achieved in these quantities.

According to an exemplary further development, the proportion of vinyl ester in the α-olefin-vinyl ester copolymer is a maximum of 50% by weight, preferably a maximum of 45% by weight, preferably a maximum of 40% by weight, preferably a maximum of 35% by weight, preferably a maximum of 30% by weight, preferably a maximum of 28% by weight, preferably a maximum of 26% by weight, preferably a maximum of 24% by weight, preferably a maximum of 22.5% by weight, preferably a maximum of 20% by weight, preferably a maximum of 19% by weight, preferably a maximum of 18% by weight, in each case based on the total weight of the α-olefin-vinyl ester copolymer. Particularly good mechanical properties and particularly good precision of the propellant charge projectile can be achieved in these quantities.

According to an exemplary further development, the proportion of vinyl ester in the α-olefin-vinyl ester copolymer is from 1 to 50% by weight, preferably 2 to 45% by weight, preferably 3 to 40% by weight, preferably 4 to 35% by weight, preferably 5 to 30% by weight, preferably 6 to 25% by weight, preferably 7 to 20% by weight, preferably 8 to 19% by weight, preferably 9 to 18% by weight, in each case based on the total weight of the α-olefin-vinyl ester copolymer. The best mechanical properties and the best precision of the propellant charge projectile can be achieved in these quantity ranges.

According to an exemplary further development, the thermoplastic elastomer is an ethylene-vinyl ester copolymer. In this context, it may be provided that the vinyl ester is a vinyl acyl ester, preferably vinyl acetate, vinyl propionate, vinyl butyrate, vinyl valerate, vinyl hexanoate, vinyl heptanoate, vinyl octanoate, vinyl nonanoate or vinyl decanoate.

According to an exemplary further development, the proportion of vinyl ester in the ethylene-vinyl ester copolymer is at least 1% by weight, preferably at least 2% by weight, preferably at least 3% by weight, preferably at least 4% by weight, preferably at least 5% by weight, preferably at least 6% by weight, preferably at least 7% by weight, preferably at least 9% by weight, in each case based on the total weight of the ethylene-vinyl ester copolymer. In these quantities, particularly good mechanical properties and particularly good precision of the propellant charge projectile can be achieved.

According to an exemplary further development, the proportion of vinyl ester in the ethylene-vinyl ester copolymer is a maximum of 50% by weight, preferably a maximum of 45% by weight, preferably a maximum of 40% by weight, preferably a maximum of 35% by weight, preferably a maximum of 30% by weight, preferably a maximum of 28% by weight, preferably a maximum of 26% by weight, preferably a maximum of 24% by weight, preferably a maximum of 22% by weight, preferably a maximum of 20% by weight, preferably a maximum of 19% by weight, preferably a maximum of 18% by weight, in each case based on the total weight of the ethylene-vinyl ester copolymer. In these quantities, particularly good mechanical properties and particularly good precision of the propellant charge projectile can be achieved.

According to an exemplary further development, the proportion of vinyl ester in the ethylene-vinyl ester copolymer is from 1 to 50% by weight, preferably from 2 to 45% by weight, preferably from 3 to 40% by weight, preferably from 4 to 35% by weight, preferably 5 to 30% by weight, preferably 6 to 25% by weight, preferably 7 to 20% by weight, preferably 8 to 19% by weight, preferably 9 to 18% by weight, in each case based on the total weight of the ethylene-vinyl ester copolymer. The best mechanical properties and the best precision of the propellant charge projectile can be achieved in these quantity ranges.

According to an exemplary further development, the thermoplastic elastomer is an α-olefin-alkyl acrylate copolymer. In this context, it may be provided that the alkyl group contained in the alkyl acrylate is C1 to C10 alkyl, preferably C1 to C6 alkyl, particularly preferably C2 to C5 alkyl, more preferably C2 to C4 alkyl. In this context, it may further be provided that α-olefin is one or more of ethylene (which in this context is to be understood as α-olefin) propylene, 1-butene, 1-pentene, 1-hexene, 1-heptene, 1-octene, 1-decene, 1-undecene, 1-icosen, and 1-docosen.

According to an exemplary further development, the proportion of alkyl acrylate in the α-olefin-alkyl acrylate copolymer is at least 1% by weight, preferably at least 2% by weight, preferably at least 3% by weight, preferably at least 4% by weight, preferably at least 5% by weight, preferably at least 6% by weight, preferably at least 7% by weight, preferably at least 8% by weight, preferably at least 9% by weight, in each case based on the total weight of the α-olefin-alkyl acrylate copolymer. Particularly good mechanical properties and particularly good precision of the propellant charge projectile can be achieved in these quantities.

According to an exemplary further development, the proportion of alkyl acrylate in the α-olefin-alkyl acrylate copolymer is a maximum of 50% by weight, preferably a maximum of 45% by weight, preferably a maximum of 40% by weight, preferably a maximum of 35% by weight, preferably a maximum of 30% by weight, preferably a maximum of 28% by weight, preferably a maximum of 26% by weight, preferably a maximum of 24.5% by weight, in each case based on the total weight of the α-olefin-alkyl acrylate copolymer. Particularly good mechanical properties and particularly good precision of the propellant charge projectile can be achieved in these quantities.

According to an exemplary further development, the proportion of alkyl acrylate in the α-olefin-alkyl acrylate copolymer is from 1 to 50% by weight, preferably from 2 to 45% by weight, preferably from 3 to 40% by weight, preferably from 4 to 35% by weight, preferably 5 to 30% by weight, preferably 6 to 25% by weight, preferably 9 to 22.5% by weight, preferably 18 to 22.5% by weight, in each case based on the total weight of the α-olefin-alkyl acrylate copolymer. The best mechanical properties and the best precision of the propellant charge projectile can be achieved in these quantity ranges.

According to an exemplary further development, the thermoplastic elastomer is an ethylene-alkyl acrylate copolymer. In this context, it may be provided that the alkyl group contained in the alkyl acrylate is C1 to C10 alkyl, preferably C1 to C6 alkyl, particularly preferably C2 to C5 alkyl, more preferably C2 to C4 alkyl. It is particularly preferred that the thermoplastic elastomer is ethylene-butyl acrylate copolymer.

According to an exemplary further development, the proportion of alkyl acrylate in the ethylene-alkyl acrylate copolymer is at least 1% by weight, preferably at least 2% by weight, preferably at least 3% by weight, preferably at least 4% by weight, preferably at least 5% by weight, preferably at least 6% by weight, preferably at least 7% by weight, preferably at least 8% by weight, preferably at least 9% by weight, in each case based on the total weight of the ethylene-alkyl acrylate copolymer. In these quantities, particularly good mechanical properties and particularly good precision of the propellant charge projectile can be achieved.

According to an exemplary further development, the proportion of alkyl acrylate in the ethylene-alkyl acrylate copolymer is a maximum of 50% by weight, preferably a maximum of 45% by weight, preferably a maximum of 40% by weight, preferably a maximum of 35% by weight, preferably a maximum of 30% by weight, preferably a maximum of 28% by weight, preferably a maximum of 26% by weight, preferably a maximum of 24.5% by weight, in each case based on the total weight of the ethylene-alkyl acrylate copolymer. In these quantities, particularly good mechanical properties and particularly good precision of the propellant charge projectile can be achieved.

According to an exemplary further development, the proportion of alkyl acrylate in the ethylene-alkyl acrylate copolymer is from 1 to 50% by weight, preferably from 2 to 45% by weight, preferably from 3 to 40% by weight, preferably from 4 to 35% by weight, preferably 5 to 30% by weight, preferably 6 to 25% by weight, preferably 9 to 22.5% by weight, preferably 18 to 22.5% by weight, in each case based on the total weight of the ethylene-alkyl acrylate copolymer. The best mechanical properties and the best precision of the propellant charge projectile can be achieved in these quantity ranges.

In a further exemplary embodiment of the projectile according to the invention, the mixture has a density of 4 to 12 g/cm3, in particular of 4.5 to 7 g/cm3 or of 5.5 to 6.5 g/cm3, particularly preferably 5.9 to 6.2 g/cm3. The density can be determined according to DIN EN ISO 1183-1 (in the form valid at the time of application). Compared to known projectiles made of metal-plastic mixtures, the projectile according to the invention has a significantly higher density while providing a desired ductility. As a result, the projectile according to the invention provides significantly improved precision.

In addition, it may be provided that the mixture has a tensile strength in the tensile test according to ISO 527-1 (in the form valid at the time of the application) of 3 MPa to 15 MPa, preferably 4 MPa to 10 MPa, more preferably 5 MPa to 8.5 MPa.

In addition, it may be provided that the mixture has an elongation at break in the tensile test according to ISO 527-1 (in the form valid at the time of application) of 0.3% to 3% , preferably 0.5% to 2.5%, more preferably 0.6% to 2.1%.

Furthermore, it may be provided that the mixture has a modulus of elasticity in the tensile test according to ISO 527-1 (in the form valid at the time of the application) of 800 MPa to 1,800 MPa, preferably 900 MPa to 1,600 MPa.

In addition, it may be provided that the mixture has a flexural modulus in the flexural test according to ISO 178 (in the form valid at the time of the application) of 1,300 MPa to 12,000 MPa, preferably 1,450 MPa to 1,900 MPa.

In addition, it may be provided that the mixture has a flexural strength in the flexural test according to ISO 178 (in the form valid at the time of the application) of 10 MPa to 20 MPa, preferably 12 MPa to 15 MPa.

In addition, it may be provided that the mixture has an elongation at break in the flexural test according to ISO 178 (in the form valid at the time of the application) of 1% to 4% , preferably 1.5% to 3%.

Furthermore, it may be provided that the mixture has a Shore D hardness of 50 to 80, preferably 60 to 68

It may also be provided that the mixture has an apparent viscosity of from 100 PDS to 1000 PDS at an apparent shear rate of from 10 to 100 1/s at 180° C. according to ISO 11443 (in the form valid at the time of application).

Similarly, it may be provided that the mixture has an apparent viscosity of from 10 PDS to 500 PDS at an apparent shear rate of from 100 to 1000 1/s at 180° C. according to ISO 11443 (as in force at the date of the application).

It can also be provided that the mixture has a glass transition of 30 to 40° C. after DSC.

It may also be provided that the mixture has a peak melting temperature of 90 to 100° C. after DSC.

It may also be provided that the mixture has an melting enthalpy of 2 to 3 J/g according to DSC.

It may also be provided that the mixture has a crystallisation temperature of 75 to 85° C. according to DSC.

It can also be provided that the mixture has an enthalpy of 2 to 2.5 J/g according to DSC. It may also be provided that the mixture has a crystallisation temperature of 400 to 450° C. according to DSC.

In a further exemplary embodiment of the propellant charge projectile according to the invention, its surface is mechanically and/or chemically treated, in particular coated, in particular painted or galvanically coated, at least in certain areas.

The propellant charge projectile is made from a mixture of metal and plastic, in particular a thermoplastic elastomer, formed by extrusion. The metal can, for example, be provided in powder form and/or the plastic in granulate form, wherein the metal powder and plastic granulate can be mixed to form a particularly homogeneous mixture.

The propellant charge projectile may comprise an injection point for the metal-plastic mixture, the surface of which is different from an adjacent surface of the propellant charge projectile. The propellant charge projectile according to the invention can therefore be manufactured using known injection moulding tools and take advantage of injection moulding technology. The metal and/or the plastic, in particular the thermoplastic elastomer, may have one or more of the above-mentioned properties. According to the present invention, the injection point may be defined as the point on the propellant charge projectile which is visible on the propellant charge projectile by removing the sprue formed during injection moulding of the mixture according to the invention. The sprue is generally a part of the injection moulded part that does not belong to the moulded part and is formed by the molten mixture guided in feed channels to the injection mould. The sprue can be removed by hand, for example by cutting or shearing or by other mechanical post-processing. The result is a visible injection point on the surface of the propellant charge projectile.

According to a further aspect of the present invention, which is combinable with the preceding aspects and exemplary embodiments (i.e. in particular that embodiments described herein for the propellant charge projectile are also embodiments for the projectile as long as they do not contradict the features characterising the projectile), there is provided a projectile, in particular a propellant charge projectile or compressed air projectile, wherein the projectile is made of a mixture comprising metal and 2 to 15% by weight of α-olefin-vinyl ester copolymer, based on the total weight of the projectile.

In a further exemplary embodiment of this projectile according to the invention, in particular propellant charge projectile or compressed air projectile, it can be provided in particular that the α-olefin-vinyl ester copolymer is an ethylene-vinyl actetate copolymer with a proportion of vinyl acetate of 6 to 25% by weight, based on the total weight of the ethylene-vinyl actetate copolymer.

In a further exemplary embodiment of this projectile according to the invention, in particular propellant charge projectile or compressed air projectile, it is provided that the metal is contained in the projectile in an amount of 85 to 98% by weight, based on the total weight of the propellant charge projectile.

Further preferred α-olefin-vinyl ester copolymers in connection with the projectile, preferred proportions of vinyl ester in the copolymer, preferred embodiments with regard to the metal, preferred embodiments with regard to the properties of the mixture and further preferred embodiments are described in the foregoing with reference to the propellant charge projectile.

According to a further aspect of the present invention, which is combinable with the preceding aspects and exemplary embodiments (i.e. in particular that embodiments described herein for the propellant charge projectile are also embodiments for the projectile as long as they do not contradict the features characterising the projectile), a projectile is provided, wherein the projectile, in particular propellant charge projectile or compressed air projectile, is made of a mixture comprising metal and 2 to 15% by weight of thermoplastic elastomer, based on the total weight of the propellant charge projectile, wherein the metal in the projectile is present in the form of particles and the particles have a median diameter D50 of 5 to 100 μm, and/or a D10 of 2 to 65 μm, and/or a D90 of 10 to 150 μm.

In a further exemplary embodiment of this projectile according to the invention, in particular propellant charge projectile or compressed air projectile, it can be provided in particular that the metal in the projectile is present in the form of particles and a width of the size distribution of the particles is from 1 to 6.

In a further exemplary embodiment of this projectile according to the invention, in particular propellant charge projectile or compressed air projectile, it is provided that the metal is contained in the projectile in an amount of 85 to 98% by weight, based on the total weight of the propellant charge projectile.

Further preferred plastics in connection with the projectile, preferred embodiments with respect to the metal, preferred embodiments with respect to the properties of the mixture and further preferred embodiments are described in the foregoing with reference to the propellant charge projectile.

According to a further aspect of the present invention, which can be combined with the preceding aspects and exemplary embodiments, there is provided ammunition comprising a propellant charge projectile or projectile according to the invention.

According to a further aspect of the present invention, which can be combined with the preceding aspects and exemplary embodiments, a method for producing a propellant charge projectile according to the invention or a projectile according to the invention is provided.

According to the method, plastic granules, in particular granules of a thermoplastic elastomer, and metal powder are provided. The plastic granulate and the metal powder are mixed and then introduced by extrusion into an injection mould forming the outer shape of the projectile. The injection pressure can be maintained until the mixture in the injection mould has cooled and, in particular, solidified. Furthermore, it may be provided that the injection mould is only opened when the mixture has completely solidified and the projectile has been completely demoulded.

It may be provided that the metal powder provided, in particular the copper powder, has a bulk density of 2 to 3 g/cm3, alternatively a bulk density of 3 to 4 g/cm3, alternatively a bulk density of 4 to 5 g/cm3.

It may also be provided that a mixture of two or more different metal powders is provided, which differ from each other in terms of their bulk density.

In a further exemplary embodiment, it may be provided that the granules have a density of 4 to 12 g/cm3, in particular of 4.5 to 7 g/cm3 or of 5.5 to 6.5 g/cm3, particularly preferably 6.0 to 6.3 g/cm3. The density can be determined according to DIN EN ISO 1183-1 (in the form valid at the time of application).

Preferred embodiments are given in the sub-claims.

The features disclosed in the above description and the claims can be of importance both individually and in any combination for the realisation of the invention in the various embodiments.

The invention claimed is:

1. A propellant charge projectile, wherein the propellant charge projectile comprises a mixture comprising metal and 2 to 15% by weight of plastic, based on the total weight of the propellant charge projectile, wherein the metal in the propellant charge projectile is present in the form of particles, and wherein the particles have a spacy, lamellar, dendritic or spherical morphology or are present in a mixture of two or more of these morphologies.

2. A propellant charge projectile according to claim 1, wherein the metal is contained in the propellant charge projectile in an amount of 85 to 98% by weight, based on the total weight of the propellant charge projectile.

3. A propellant charge projectile according to claim 1, wherein the metal is selected from the group consisting of copper, iron, zinc, tin, magnesium, tungsten, tungsten carbide, sintered metal and mixtures thereof.

4. A propellant charge projectile according to claim 1, wherein the particles have a median diameter D50 of 5 to 100 μm, and/or a D10 of 2 to 65 μm, and/or a D90 of 10 to 150 μm.

5. A propellant charge projectile according to claim 4, wherein a width of the size distribution of the particles is from 1 to 6, wherein the width of the size distribution is defined as (D90-D10)/D50.

6. A propellant charge projectile according to claim 1, wherein the plastic is a thermoplastic elastomer.

7. A propellant charge projectile according to claim 1, wherein the plastic is selected from an α-olefin-vinyl ester copolymer, an α-olefin-alkyl acrylate copolymer or mixtures of two or more thereof.

8. A propellant charge projectile according to claim 1, wherein the plastic is selected from an ethylene-vinyl ester copolymer, an ethylene-alkyl acrylate copolymer or mixtures of two or more thereof.

9. A propellant charge projectile according to claim 1, wherein the plastic is selected from ethylene-methyl acrylate copolymer, ethylene-butyl acrylate copolymer, ethylene-vinyl actetate copolymer and mixtures of two or more thereof.

10. A propellant charge projectile according to claim 1, wherein the mixture has a density of 4 to 12 g/cm$^3$.

11. A propellant charge projectile, in particular according to claim 1, wherein the propellant charge projectile is made from a mixture of metal and plastic formed by extrusion and has an injection point for the metal-plastic mixture, wherein a surface of the injection point differs from an adjacent surface of the projectile.

12. A propellant charge projectile according to claim 1, the surface of which is mechanically and/or chemically treated at least in certain areas.

13. A projectile, wherein the projectile is made from a mixture comprising metal and 2 to 15% by weight of α-olefin-vinyl ester copolymer, based on the total weight of the projectile, and wherein the α-olefin-vinyl ester copolymer is an ethylene-vinyl actetate copolymer with a proportion of vinyl acetate of 9 to 18% by weight, based on the total weight of the ethylene-vinyl actetate copolymer.

14. A projectile, wherein the projectile is made of a mixture comprising metal and 2 to 15% by weight of thermoplastic elastomer, based on the total weight of the propellant charge projectile, wherein the metal in the projectile is in the form of particles and the particles have a median diameter D50 of 5 to 100 μm, and/or a D10 of 2 to 65 μm, and/or a D90 of 10 to 150 μm, and wherein the metal in the projectile is in the form of particles and a width of the size distribution of the particles is from 1 to 6, the width of the size distribution being defined as (D90-D10)/D50.

15. An ammunition comprising a propellant charge projectile according to claim 1.

16. A method for producing a propellant charge projectile according to claim 1, in which plastic granules and metal powder are provided, the plastic granules and the metal powder are mixed and then introduced by extrusion into an injection mould forming the outer shape of the projectile.

* * * * *